United States Patent [19]

Bergh

[11] 4,377,924

[45] * Mar. 29, 1983

[54] PORTABLE DEVICE FOR TREATING SURFACES

[75] Inventor: John C. Bergh, Elkhart, Ind.

[73] Assignee: Wheelabrator-Frye Inc., Hampton, N.H.

[ * ] Notice: The portion of the term of this patent subsequent to Mar. 29, 2000, has been disclaimed.

[21] Appl. No.: 662,467

[22] Filed: Mar. 1, 1976

[51] Int. Cl.[3] ..... B24C 3/06

[52] U.S. Cl. ..... 51/429

[58] Field of Search ..... 51/9 M, 428, 429

[56] References Cited

U.S. PATENT DOCUMENTS

| | | | |
|---|---|---|---|
| 3,034,262 | 5/1962 | Pawlson | 51/9 M |
| 3,608,968 | 9/1971 | Burnett | 51/9 M X |
| 3,900,969 | 8/1975 | Diehn | 51/9 M |

*Primary Examiner*—James G. Smith

*Attorney, Agent, or Firm*—McDougall, Hersh & Scott

[57] ABSTRACT

A portable device for treatment of surfaces, preferably horizontal, comprising a centrifugal wheel for projecting abrasive particles onto the surface at an angle with the surface, a feed hopper for supplying abrasive particles to the wheel, a rebound corridor extending angularly upwardly and into which the abrasive particles rebound upon striking the surface, and means for inducing air flow into the blast area and through the rebound corridor for enhancing removal and recovery of abrasive particles.

17 Claims, 2 Drawing Figures

PORTABLE DEVICE FOR TREATING SURFACES

This invention relates to a device for treatment of surfaces with particulate material thrown at high velocity onto a surface and it relates more particularly to a portable device which makes use of one or more wheels having radially extending blades for throwing, by centrifugal force, particulate material onto the surface for cleaning, abrading, or other surface treatment.

Recovery for re-use of abrasive or other particulate material is essential to the economical operation of the apparatus, otherwise the cost of particulate material or abrasive becomes excessive, the means for supplying the otherwise large volumes of abrasive material would impose a similar problem of size and weight, and the means for disposal of spent abrasive material would increase the problem of size and weight.

Recovery of particulate material and abrasives entails the problems of removal of the particulate material and abrasive from the surface, separating re-usable particulate material and abrasive from dust, dirt and fines, and returning the cleaned particulate material or abrasive for recycle to the centrifugal blasting wheel.

Such recovery, cleaning and recycle of cleaned particulate material and abrasive should be provided with the centrifugal wheels and housings if the unit is intended for use as a portable surface cleaning or treating device.

Present surface tretment devices of the type described, especially for the treatment of horizontal surfaces, such as floors, ships' decks, roads, runways and the like, are very large and difficult to maneuver in relatively small areas. A great deal of the length and weight is taken up by the recovery, cleaning and recycle system for the spent particulate material or abrasive.

It is an object of this invention to provide a portable surface treating device of the type described which is of a size and weight to be easily maneuverable over the surface to be cleaned or otherwise treated, in which means are provided for recovery of the re-usable abrasive or other particulate material, in which the recovered abrasive or particulate material is cleaned and recycled in a simple and efficient manner which requires a minimum of space and additional equipment, and in which the abrasive or other particulate material is substantially completely removed from the cleaned or treated surfaces thereby to minimize the loss of material, and the amount of additional cleaning required to remove the dust and residue from the cleaned or treated surfaces.

Figure 1:
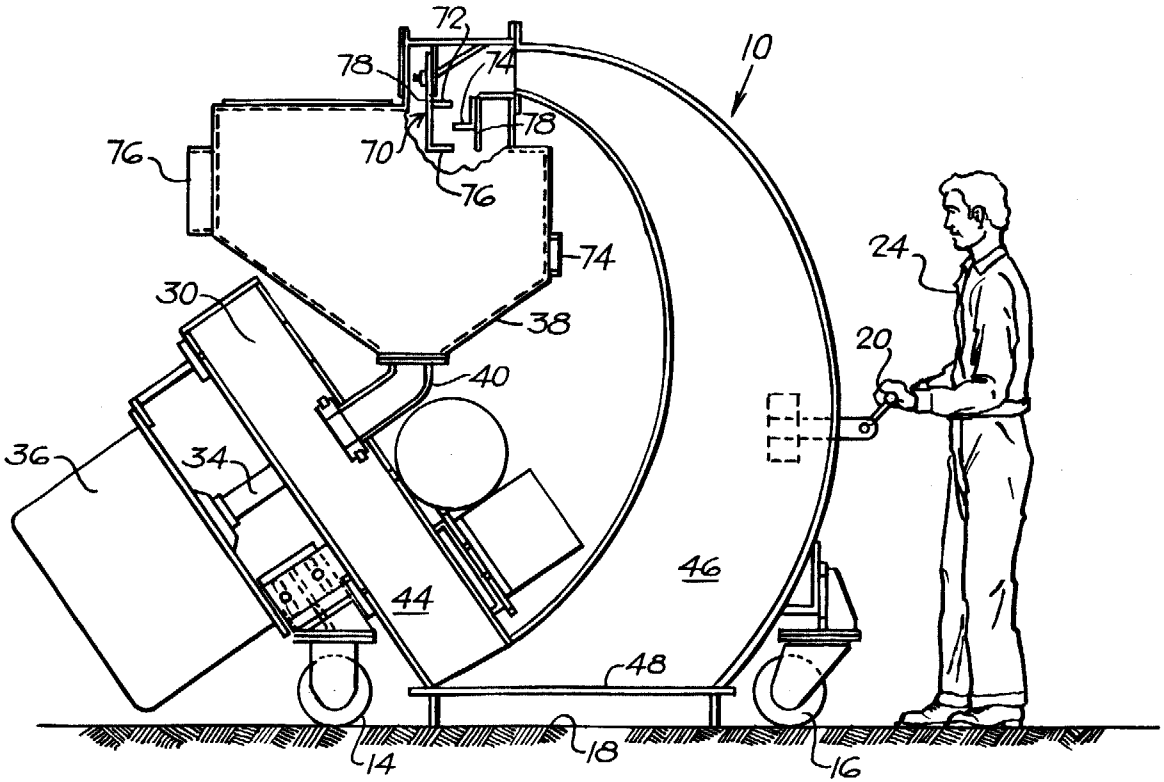
Figure 2:
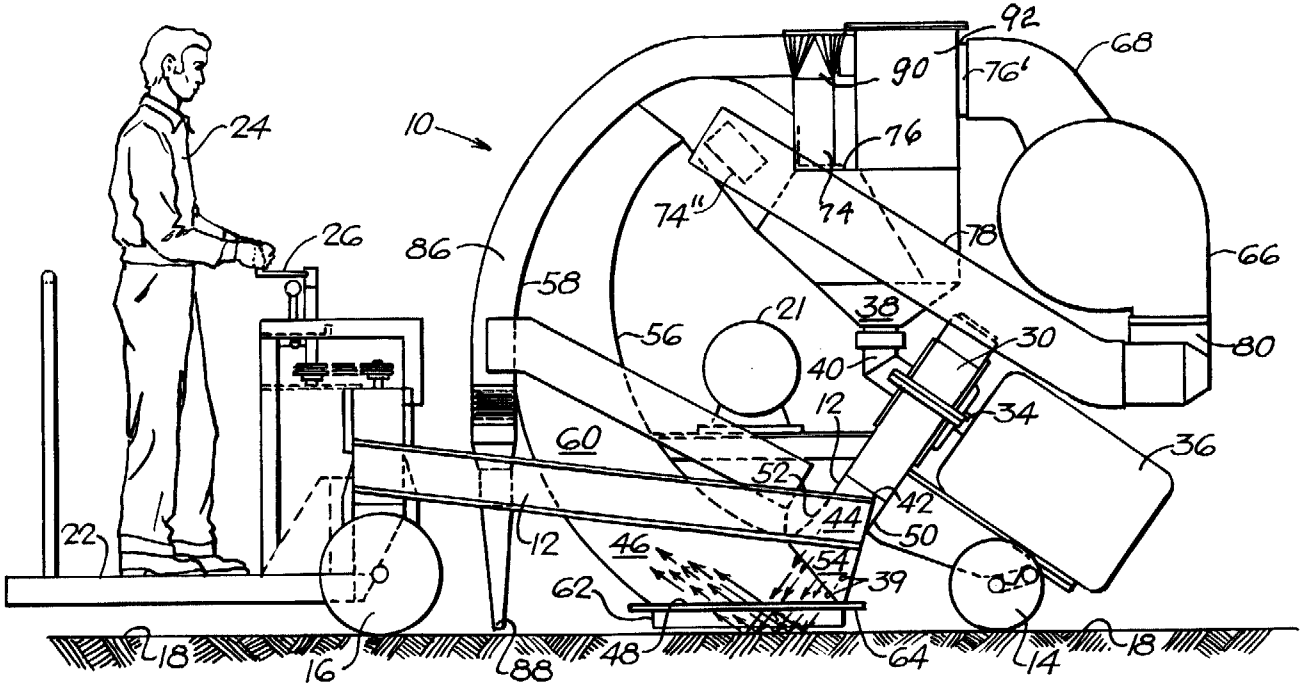

These and other objects and advantages of this invention will hereinafter appear and for purposes of illustration, but not of limitation, an embodiment of the invention is shown in the accompanying drawings, in which FIG. 1 is a schematic sectional elevational view showing the essential elements of a portable apparatus embodying the features of this invention for cleaning a floor, ship's deck, or other horizontally disposed surface; and FIG. 2 is an elevational plan view of a modified apparatus of the type shown in FIG. 1.

The invention will be described with reference to an apparatus for cleaning a horizontally disposed, relatively flat surface, such as a floor 18, ship's deck, airport runway, street and the like, but it will be understood that the apparatus to be described has application also for the treatment of surfaces other than flat and other than horizontal, such for example as a rolling surface, inclined surface and even a vertical surface.

While the invention will hereinafter be described with reference to the use of hard abrasive particles for cleaning such surfaces, it will be understood that the apparatus of this invention has application for the treatment of surfaces with other particulate material for use in cleaning surfaces, removal of surface finishes, hardening surfaces as by peening or impacting, and for providing certain finishes to a metal, plastic, wooden and the like surface. The type of surface treatment or finish depends somewhat upon the type of particulate material projected onto the surface such as steel shot, steel grit, metal abrasive, sand for surface cleaning, or softer materials such as particulate organic materials in the form of nut shells, nut seeds, wooden or plastic particles and the like for surface finishing, hereinafter collectively referred to as abrasive particles.

Referring now to the drawings, illustration is made of an apparatus 10 which includes a rigid frame 12 mounted on wheels 14, one of which is in the form of a caster wheel 16 for enabling movement of the apparatus in various directions over the surface 18 to be treated. The apparatus may be adapted for movement by hand, in which event handle bars 20 are provided to extend rearwardly from the frame, or the apparatus may be powered for movement over the surface, as by means of a hydraulic motor drive 21, in which event a platform 22 is provided to extend rearwardly from the frame and on which the operator 24 rides, with steering means 26 for maneuvering the apparatus over the surface to be treated.

The apparatus 10 is provided with one or more centrifugal wheels 30 enclosed within a protective housing 12. The wheel 30 is generally referred to as a centrifugal blasting wheel, of the type well known to the trade, and marketed by Wheelabrator-Frye Inc., of Mishawaka, Ind., under the name WHEELABRATOR. The wheel is rotated at high speed on an axle 34 driven by an electrical motor 36. Instead of a direct motor drive, rotational movement at high speed can be imparted to the wheel by means of a belt drive which interconnects a pulley on the end of the axle with a motor driven sheave offset from the wheel axis.

Abrasive particles are fed from a supply hopper 38 through a feed spout 40 to a cage in the center of the wheel. The cage dispenses the abrasive particles onto the inner end portion of the blades 42 which extend radially outwardly in circumferentially spaced relation from the hub whereby, in response to rotational movement of the wheel, the abrasive particles 39 are displaced radially outwardly over the surfaces of the blades and thrown with high centrifugal force from the ends of the blades in a direction controlled by the cage. The rate of flow of particulate material is controlled by a control valve in the feed system.

As illustrated in FIG. 1, the wheel axis is inclined so that the abrasive particles will be thrown from the blades angularly downwardly through a similarly inclined blast corridor 44 onto the surface 18. The cleaning efficiency and rebound of the abrasive particles, for best recovery, is somewhat dependent upon the angle of inclination at which the abrasive particles strike the surface which angle corresponds to 90° minus the angle of inclination that the wheel axle makes with the horizontal. The angle of inclination that the wheel axle makes with the horizontal should be less than 60° and not less than 10° so that the angle at which the abrasive particles strike the surface will not be less than 30° nor greater than 80° and preferably within the range of 45° to 65°.

When the abrasive particles are thrown at high velocity angularly onto the surface, they tend to rebound from the surface at a reflective angle. For recovery of the spent abrasive particles, there is provided a rebound corridor 46 which extends upwardly from the surface, initially at an angle corresponding to the reflective angle to 10° to 15° less than the reflective angle. The angular relationship of the rebound corridor increases through the upper portions thereof for guiding the rebounding abrasive particles upwardly preferably to a level above the hopper 38 and preferably through a backward angle of more than 180° with the surface for continued movement of the rebounding abrasive particles in response to gravitational force after the particles pass the zenith of the rebound corridor 46.

Thus the blast corridor 44 and the rebound corridor 46 merge at their lower end portions to provide a downwardly facing opening 48 therebetween, which defines the blast area through which the abrasive particles are thrown onto the surface and from which they rebound for return through the rebound corridor 46.

The blast corridor is defined by front and back walls 50 and 52 and side walls 54 while the rebound corridor is defined by front and back walls 56 and 58 and side walls 60. The lower edges of the walls 50, 58, 54 and 60, which define the opening 48, terminate a short distance above the surface 18. The area is enclosed by a resilient skirt 62 which depends from a bracket 64 fixed to the lower edge portions of the surrounding walls. The skirt 62 is intended to enclose the area to confine the blast and to prevent ricocheting of abrasive particles to the region outside of the housing. The skirt is dimensioned to have a length and is characterized by sufficient flexibility to permit abrasive particles, collected on a surface 18, to pass beneath the skirt and to permit air to be drawn about the underside of the skirt from the outside atmosphere into the blast area, as will hereinafter be described. For this purpose, the skirt is formed of a rubber-like material dimensioned preferably to engage the surface or to terminate a short distance above the surface.

An important concept of this invention resides in the means for inducing large volumes of air to enter into the blast area, especially into the zones immediately surrounding the blast area for entrainment of fines, dust, dirt and abrasive particles within the blast area. The air flow serves to induce the entrainment of residual abrasive particles, dust and dirt which fall back onto the surface and to supplement the kinetic energy of the rebounding particles for travel through the rebound corridor.

The flow of air into the blast chamber is induced, in part, by the fan of the dust collector and by the rotation of the blast wheel as well as the abrasive particles traveling at high velocity through the blast chamber whereby subatmospheric conditions exist within the blast chamber. This causes air to be drawn into the blast chamber from the outside atmosphere about the underside of the skirt. This operates to sweep residual particles from the surface into the main stream and to induce the particles to rise into the main stream and join the line of travel of the rebounding particles into and through the rebound corridor.

In addition to the air flow maintained by the blower 66, the velocity at which the particles travel into and out of the blast area is effective to increase the force of the air stream further to induce the desired sweeping action and entrainment of particles for their re-entry into the line of flow of the rebounding particles for travel through the rebound corridor.

Thus the kinetic energy of the particles plus the induced air flow is employed to collect the spent abrasive particles and to carry them with the dust, dirt and other fines from the surface, through the rebound chamber, to a cleaning cycle, such as an air wash and return to the feed hopper for re-use.

This eliminates the need for collectors and conveyors otherwise required to recover the abrasive particles and to recycle the re-usable abrasive to the blast wheel. It also eliminates the need to incorporate means for otherwise dissipating the kinetic energy imparted to the abrasive particles by the wheel and it minimizes the excessive wear of surfaces by abrasive whereby frequent repair or replacement is required.

In the modification shown in FIG. 1, the air wash 70 immediately underlies the end of the rebound chamber. The air wash comprises a series of vertically staggered shelves, such as shelves 72, 74,76, extending inwardly from opposite side walls 78 with the inner of the shelves overlapping so that as the particulate material builds up on an upper shelf, the material overflows the upper shelf onto a lower shelf in a manner to distribute the particulate material so that it will fall as a uniform curtain from the lowermost shelf 76. Air at controlled velocity is circulated through the curtain from an inlet 74 at one side to an outlet 96 at the other. The air with entrained dust and fines is conveyed from the outlet 76 to the blower 66.

In the modification shown in FIG. 2, use is made of a centrifgual fan 66 having an inlet at the central axis which communicates through duct 68 with an outlet 76' to an expansion chamber. Duct 78 communicates the outlet 80 from a peripheral portion of the centrifugal fan with an inlet 74" on the other side of the air wash housing 70.

In operation, abrasive particles, such as steel shot, rebound from the surface 18 through the scroll 60 into the air wash separator 70. Air introduced through the inlet 74" crosses the curtain of abrasive particles and dusts falling from the shelf 76 and entrains the dusts and fines for removal from the abrasive particles. The abrasive particles fall gravitationally into the hopper 38 while the air, with entrained dusts and fines, is removed via duct 90 for transfer to a dust collector. Particulate residue that remains on the surface 18 passes under the skirt 62 and is picked up by a vacuum cleaner nozzle 88 for transfer through duct 86 to an expansion chamber 92. In the expansion chamber, the abrasive particles fall gravitationally into the supply hopper 38, while the dusts and fines flow with the air through outlet 76' into duct 68, to the inlet to the fan 66 and provide the air stream which is circulated through the duct 76 to the inlet 74. As described, the dirty air from the air wash goes to the dust collector.

The relatively small amount of abrasive particles, which do not traverse the rebound corridor, fall back onto the surface and pass under the skirt 62 about the blast area. These particles are picked up by the trailing auxiliary pickup unit, illustrated in FIG. 2 as a vacuum cleaner, but which may otherwise be in the form of a magnetic drum, rotating brush or the like. It will be understood that the power requirement for operating such auxiliary unit to pick up the small amount of abrasive particles remaining on the surface 18 is materially less than the power that would otherwise be required fully to recover the abrasive particles within the blast unit itself.

Since the great majority of the abrasive particles, entrained dust and fines, rebound with sufficient kinetic energy to pass through the rebound corridor for cleaning and for return of the re-usable abrasive particles to the supply hopper, it is possible markedly to increase the recovery capabilities of the device without placing great reliance on auxiliary recovery systems which can therefore by made to operate simply and efficiently, and without the need to utilize much space or energy for substantially complete recovery of the abrasive particles.

The cleaning effect is derived, at least in part, by the heat of the abrasive particles thrown sequentially by the radially spaced blades of the wheel, while the latter is rotating at high speed.

Instead of making use of gravity feed from the hopper to the wheel, use can be made of other systems for feeding particulate material to the wheel such as a pneumatic feed, screw feed, or other means for positive displacement of abrasive particles in the desired amounts. Under such circumstances, it is not essential to have the rebound corridor rise to a certain level, although it is preferred that the rebound corridor terminate at a downward incline so as to be able to take advantage of gravitational forces for continued processing of the recovered particles.

Instead of handle bars 20 or platform 22 being mounted on the rear of the apparatus, it will be understood that such control means can be provided on the opposite end or both ends of the apparatus for enabling movement in either direction.

From the foregoing, it will be apparent that an apparatus is provided for the treatment of surfaces in which utilization is made of kinetic energy resident in the abrasive particles to enable recovery of the abrasive particles in an efficient and economical manner whereby size, weight and cost of the unit can be greatly reduced, while providing greater maneuverability, by hand or by power operated means, over the surface to be treated.

It will be understood that changes may be made in the details of construction, arrangement and operation without departing from the spirit of the invention, especially as defined in the following claims.

I claim:

1. A portable surface treating apparatus comprising a housing having a horizontally disposed bottom wall and a blast opening in the bottom wall adapted to overlie a horizontally disposed surface to be treated, a blast corridor extending angularly downwardly into the opening, means for projecting abrasive particles angularly downwardly through the blast corridor and through the opening onto the surface, a rebound corridor extending angularly upwardly from the opening at about a mirror angle to the blast corridor whereby abrasive particles rebound upon impact with the surface into the rebound corridor, means communicating with the rebound corridor for inducing the flow of air from the atmosphere surrounding the blast opening, into the blast opening and through the rebound corridor for inducing the removal of abrasive and other particles from the surface while aiding the rebounding particles to travel through the rebound corridor, said rebound corridor deminishing in cross section from adjacent the opening.

2. An apparatus as claimed in claim 1 which includes a gravity feed hopper for supplying the projecting means with abrasive material.

3. An apparatus as claimed in claim 2 in which the rebound corridor extends angularly upwardly to a level above the hopper for return of abrasive particles by gravity from the rebound corridor to the hopper.

4. An apparatus as claimed in claim 3 which includes an air wash between the end of the rebound corridor and the hopper for removal of fines and dust from the abrasive particles before return to the hopper.

5. An apparatus as claimed in claim 1 in which the blast corridor extends at an angle within the range of 30° to 80° to the surface.

6. An apparatus as claimed in claim 5 in which the rebound corridor extends at an angle of 0° to 15° less than the mirror angle of the blast corridor.

7. An apparatus as claimed in claim 1 in which the means for inducing air flow into the opening and through the rebound corridor comprises an exhaust fan.

8. An apparatus as claimed in claim 1 which includes a resilient skirt depending from the housing about the blast opening substantially into engagement with the surface whereby the air is drawn about the underside of the skirt and into the blast opening adjacent the outer portions thereof.

9. An apparatus as claimed in claim 2 in which the rebound corridor extends upwardly at a backward angle of at least 180° to a level above the hopper whereby the end of the corridor extends at a downward angle in the direction towards the hopper.

10. A portable surface treating apparatus comprising a housing having a horizontally disposed bottom wall and a blast opening in the bottom wall adapted to overlie a horizontally disposed surface to be treated, a blast corridor extending angularly downwardly into the opening, means for projecting abrasive particles angularly downwardly through the blast corridor and through the opening onto the surface, a rebound corridor extending angularly upwardly from the opening at about a mirror angle to the blast corridor whereby abrasive particles rebound upon impact with the surface into the rebound corridor, means communicating with the rebound corridor for inducing the flow of air from the atmosphere surrounding the blast opening, into the blast opening and through the rebound corridor for inducing the removal of abrasive and other particles from the surface while aiding the rebounding particles to travel through the rebound corridor, said rebound corridor defining a curvilinear path for the abrasive particles rebounding therethrough.

11. An apparatus as claimed in claim 10 which includes a gravity feed hopper for supplying the projecting means with abrasive material.

12. An apparatus as claimed in claim 10 in which the rebound corridor extends upwardly to a level above the hopper for return of abrasive particles by gravity from the rebound corridor to the hopper.

13. An apparatus as claimed in claim 12 which includes an air wash between the end of the rebound corridor and the hopper for removal of fines and dust from the abrasive particles before return to the hopper.

14. An apparatus as claimed in claim 10 in which the blast corridor extends at an angle within the range of 30° to 80° to the surface.

15. An apparatus as claimed in claim 10 in which the means for inducing air flow into the opening and through the rebound corridor comprises an exhaust fan.

16. An apparatus as claimed in claim 10 which includes a resilient skirt depending from the housing about the blast opening and extending substantially into engagement with the surface whereby the air is drawn about the underside of the skirt and into the blast opening adjacent the outer portions thereof.

17. An apparatus as claimed in claim 11 in which the rebound corridor extends upwardly through an angle of at least 180° and to a level above the hopper whereby the end of the corridor extends at a downward angle in the direction towards the hopper.

* * * * *